US005577606A

United States Patent [19]

Schwentuchowski et al.

[11] Patent Number: 5,577,606

[45] Date of Patent: Nov. 26, 1996

[54] PACKAGING FOR SPARK PLUGS

[75] Inventors: Werner Schwentuchowski, Pfinztal; Kai Hartmann, Wengen; Volker Woelfer, deceased, late of Karlsruhe, Germany, by Katrin Woelfer, legal representitive and Brigitte Woelfer, legal representitive.

[73] Assignee: Robert Bosch GmbH, Stuttgart, Germany

[21] Appl. No.: 351,420

[22] PCT Filed: Apr. 7, 1994

[86] PCT No.: PCT/EP94/01073

§ 371 Date: Dec. 15, 1994

§ 102(e) Date: Dec. 15, 1994

[87] PCT Pub. No.: WO94/24017

PCT Pub. Date: Oct. 27, 1994

[30] Foreign Application Priority Data

Apr. 15, 1993 [DE] Germany ..... 4312273.6

[51] Int. Cl.[6] ..... B65D 75/00

[52] U.S. Cl. ..... 206/327; 206/485; 206/782

[58] Field of Search ..... 206/45.14, 45.19, 206/45.31, 45.34, 701, 327, 485, 775, 776, 777, 778, 782, 758, 765

[56] References Cited

U.S. PATENT DOCUMENTS

| | | | |
|---|---|---|---|
| 2,744,622 | 5/1956 | Sparks | 206/45.14 |
| 3,157,275 | 11/1964 | Tolaas | 206/45.14 |
| 4,362,239 | 12/1982 | Roccaforte | 206/45.14 |
| 4,570,787 | 2/1986 | Forbes, Jr. | 206/485 X |
| 5,392,919 | 2/1995 | Passamoni | 206/485 X |
| 5,428,940 | 7/1995 | Paumen et al. | 206/45.14 X |

FOREIGN PATENT DOCUMENTS

| | | |
|---|---|---|
| 1748569 | 7/1957 | Germany . |
| 9017110 | 4/1991 | Germany . |
| 9109882 | 1/1992 | Germany . |
| 9202235 | 5/1992 | Germany . |
| 4103018 | 8/1992 | Germany . |

*Primary Examiner*—Jacob K. Ackun

*Attorney, Agent, or Firm*—Edwin E. Greigg; Ronald E. Greigg

[57] ABSTRACT

A package for spark plugs including a packaging material blank which is folded to form two hollow wall portions which receive opposite ends of the spark plugs. An intermediate section which is intregally connected to the hollow wall portions and a tab if formed onto one of the hollow wall portions, so that the same side of the package material blank always points outwards. A cover or a sleeve is arranged to cover the follow wall portions and the intermediate section as protection against theft. Viewing windows, and tear tabs which are bounded by perforations permit the spark plugs to be checked and removed easily.

17 Claims, 2 Drawing Sheets

PACKAGING FOR SPARK PLUGS

PRIOR ART

The invention is based on a package for spark plugs or defined hereinafter. Packagings of this kind are mainly used for packaging of ampoules, bottles or the like containing pharmaceutical products. It suggests itself also to use such packagings for other objects such as spark plugs. It is a disadvantage of the packaging disclosed for example in DE-GM 90 17 110.1 that it has a low degree of stability as a result of the single-layer structure between the two hollow walls so that it is preferably used as an insert in a folding cardboard box and therefore does not permit the type and number of packaged objects to be seen. As a result, it is necessary to open the packaging to check whether its contents are complete. Furthermore, sufficient protection against theft is not provided since individual objects can easily be removed from such a package.

ADVANTAGES OF THE INVENTION

The packaging according to the invention has, in contrast with the above, an advantage that as a result of an intermediate element which is arranged between the hollow walls and is connected integrally thereto, only one side of the packaging material blank can be viewed from the outside so that a cardboard box which is painted on one side can be used for the packaging material blank. In addition, the stability of the packaging is increased by the intermediate element.

By virtue of the developments disclosed hereinafter, improvements in the packaging disclosed are possible. By virtue of the features set forth, a defined seat and a selective guidance of the spark plugs in the packaging is achieved, which ensures definite positional securing. By virtue of one embodiment set forth herein use as a suspended display packaging is possible. In particular, the stability of the packaging is increased by the use of tabs. Particular protection against theft is ensured by use of a cover connected to the tabs. By virtue of this design, it is only possible to remove spark plugs from the packaging by obviously damaging it. After removing tear tabs which are bounded by perforations, spark plugs can be easily removed from the packaging.

DRAWING

Exemplary embodiments of the invention are illustrated in the drawing and explained in greater detail in the subsequent description. FIG. 1 shows a plan view of a packaging blank for packaging four spark plugs; FIG. 2 shows a diagrammatic view of the folded and bonded packaging material blank from FIG. 1, FIG. 3 shows a cross-section of the packaging with spark plugs in the plane along lines III—III from FIG. 2; FIG. 4 shows a diagrammatic view of a cover serving as a protection against theft; FIG. 5 shows a diagrammatic view of a sleeve serving as protection against theft; and FIG. 6 shows a diagrammatic view of a packaging, provided with a cover or a sleeve, for four spark plugs.

DESCRIPTION OF THE EXEMPLARY EMBODIMENT

Figure 1:
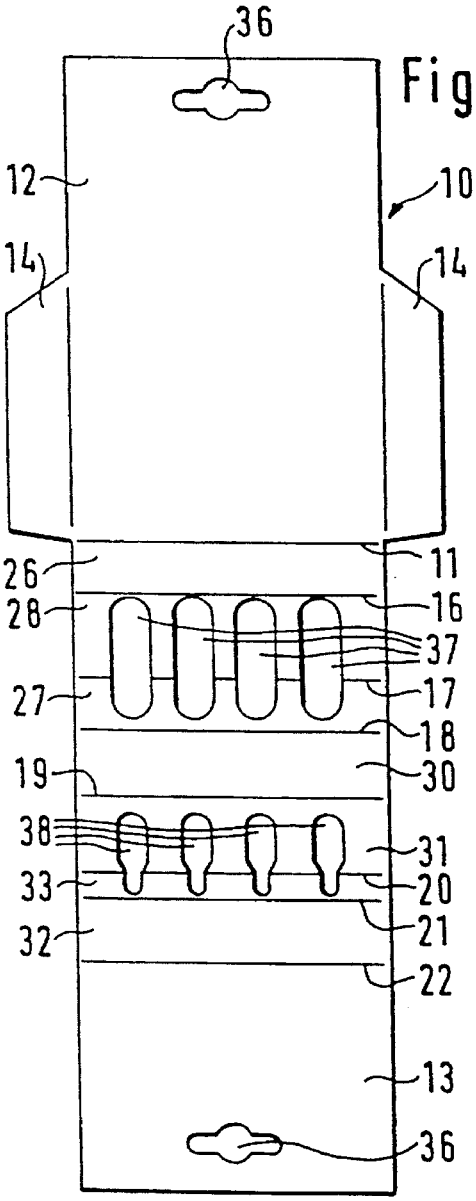
Figure 2:
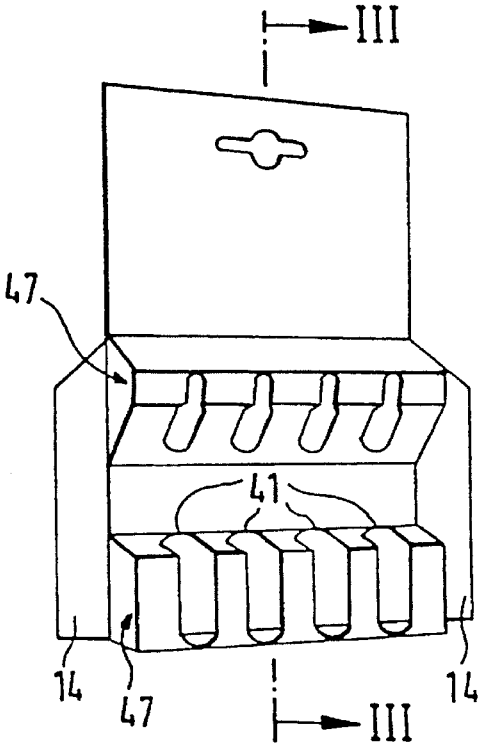
Figure 3:
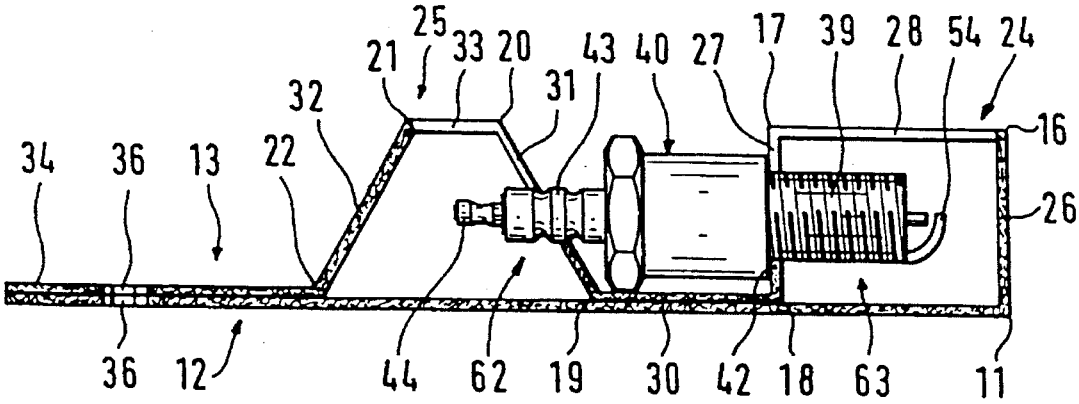

A packaging material blank 10 (FIG. 1) consists of an elongated, essentially rectangular cardboard form which is painted and printed on one side. This packaging material blank 10 is divided up, by folding over along a transversely extending folding line 11, into a section which serves as a rear wall 12 and into a front wall 13 so that the painted and printed side of the cardboard box always points outwards. Two side tabs 14 are formed laterally on the rear wall 12. The front wall 13 is divided up into sections by a plurality of transversely extending folding lines 16, 17, 18, 19, 20, 21 and 22, which sections are folded as shown in FIG. 2 and FIG. 3 to form two spaced hollow wall portions 24 and 25. One hollow wall portion 24 which adjoins the folding line 11 has two walls 26 and 27 which project perpendicularly from the rear wall 12 and one wall 28 which is parallel thereto. The wall 27 is connected to the rear wall at folding line 18. The second hollow wall portion 25 is integrally connected to the first hollow wall portion 24 at the folding lines 18 and 19 by means of an intermediate section 30. The said second hollow wall portion 25 has two walls 31 and 32 which extend obliquely with respect to one another and a wall 33 which connects the latter and extends parallel to the rear wall 12. The second hollow wall portion 25 is of preferably trapezoidal cross-section. By means of the folding line 22, a tab 34 is connected to the second hollow wall portion 25, which tab 34 rests on the rear wall 12 and is bonded thereto over its entire surface or over part of its surface.

In the walls 27 and 31 which lie opposite one another, openings 37 and 38 are arranged. These openings continue preferably into the adjoining hollow portions 24 and 25 which are parallel to the rear wall 12. The thread part 39 of the spark plugs 40 protrude into one hollow wall portion 24 through the openings 37 in the said hollow wall 27.

Figure 4:
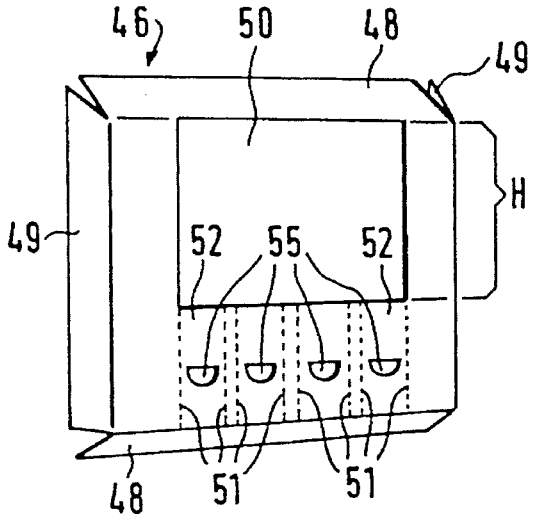

The wall portion 27 of the hollow wall 24 which is perpendicular to the rear wall 12 and to the intermediate element 30 forms a seat 41 for the close fit 42 of the spark plug 40 against the threaded part 39. The openings 38 in the other hollow wall portion 25 have a wide cross-section in the oblique wall 31, connected to the intermediate element 30, for receiving, positionally securing and guiding the insulator part 43 of the spark plug 40, and a narrow cross-section in the wall 33 parallel to the rear wall 12. The narrow cross-section in the wall 33 corresponds to the thickness of the terminal electrode 44 of the spark plug 40. The spark plug 40 is removed from the packaging by tilting the insulator part 43 out of the opening 38 of the oblique wall 31 and subsequently pulling the threaded part 39 of the spark plug 40 out of the seat 41 of the wall 27. In each case one congruent opening 36 is arranged in the tab 34 and the rear wall 12. The said opening 36 which serves for suspending the package is in the form of a circle, a longitudinal slot or preferably a combination of both. The packaging which is described above is suitable per se for holding spark plugs 40 during marketing. In order to ensure protection against theft, the hollow wall portions 24 and 25 of the front wall 30 are additionally covered. For this purpose, a cover 46 (FIG. 4) is used which covers the front walls of the two hollow wall portions 24 and 25, their walls 26 and 32 which face away from one another and the side tabs 14 which are folded over from the rear wall 12 onto the end sides 47 of the hollow wall portions 24 and 25. The cover 46 has formed-on transverse tabs 48 and longitudinal tabs 49 whose inner faces are bonded to the wall portions 26 and 32, facing away from one another, of the hollow wall portions 24 and 25 and to the side tabs 14.

In order to be able to determine the type and number of packaged spark plugs 40, the cover 46 has a viewing window 50 whose height H extends from the folding line 17 of the hollow wall portion 24 as far as the folding line 21 of the hollow wall portion 25. In order to remove the spark plugs 40 from the packaging more easily, at least one tear tab 52 which is bounded by perforations 51 is arranged in the section of the cover 46 bounding the viewing window 50 at the level of the seat 41 of the spark plugs 40. Advantageously, a tear tab 52 is arranged over the thread part 39 of each spark plug 40 so that individual spark plugs 40 can be removed from the packaging without adversely affecting the protection of the spark plugs 40 remaining in the packaging. Furthermore, a window 55, whose contour is preferably semicircular, is arranged over the electrode 54 of each spark plug 40 for checking purposes.

Figure 5:
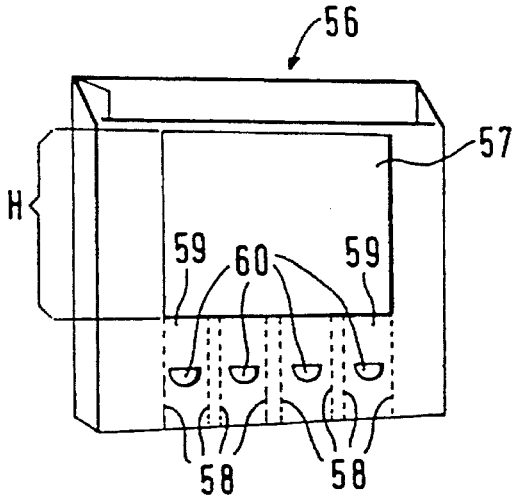
Figure 6:
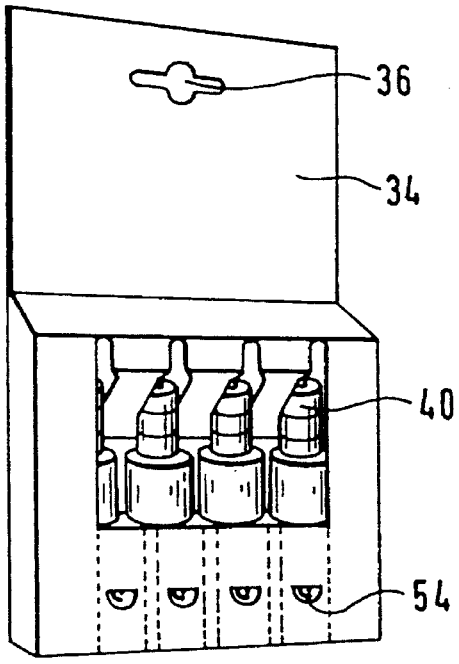

Instead of the cover 46, a sleeve 56 (FIG. 5) can be used as protection against theft. The sleeve 56 which, in contrast with the cover 46, also covers an area of the rear wall 12 is permanently connected to the packaging by the side tabs 14 which are folded over and glued to the end sides 47 of the hollow wall portions 24 and 25. As in the case of the cover 46, a viewing window 57, tear tabs 59 bounded by perforations 58 and window 60 are also formed in the sleeve 56. By forming the abovementioned features in the same way, a uniform appearance of the packaging (FIG. 6) provided with the cover 46 or the sleeve 56 can achieved.

The foregoing relates to preferred exemplary embodiments of the invention, it being understood that other variants and embodiments thereof are possible within the spirit and scope of the invention, the latter being defined by the appended claims.

We claim:

1. A package for at least one spark plug (40) formed from a packaging material blank (10) which is formed of cardboard and comprises a planar rear wall (12), a front wall (13), and has first and second hollow portions (24 and 25) which are formed by the rear wall (12) and the front wall (13), said first hollow portion having a first side (27), said second hollow portion having a second side (31), said first and second sides lying opposite one another along a length of said package, said first side (27) having a first opening (37) for receiving a first end portion (63) of said at least one spark plug (40), said second side (31) having a second opening (38) for receiving a second end portion (62) of said at least one spark plug (40), the first and second sides (27, 31) of the first and second hollow portions (24, 25) lying opposite one another are connected to one another by means of an intermediate section (30) of said front wall which is connected integrally to said first and second hollow portions (24, 25), said front wall (13) has a tab (34) which projects at one end of said second hollow portion (25) and is permanently connected to a protruding part of the rear wall (12), a cover (46) encloses the first and second hollow portions (24, 25) and the intermediate section (30) in a covering fashion, and the cover (46) is permanently connected to side tabs of the rear wall (14) and does not enclose the front wall tab and the protruding part of the rear wall.

2. A package according to claim 1, in which said first side (27) of said first hollow portion (24) protrudes at a right angle from the intermediate section (30) and forms a seat (41) for a threaded close fit first end (42) of the at least one spark plug (40), and the second side (31) protrudes obliquely from the intermediate section (30) and forms a seat for a second end (43) of said at least one spark plug.

3. A package according to claim 1, in which the first opening (37) continues in a first wall section (28) of said first hollow portion (24) and said second opening (38) continues in a second wall section (33) of said second hollow portion (25) and in which said first and second wall sections (28 and 33) are parallel to the rear wall (12) of the first and second hollow portions (24, 25).

4. A package according to claim 2, in which the first opening continues in a first wall section (28) of said first hollow portion (24) and said second opening (38) continues in a second wall section (33) of said second hollow portion (25) and in which said first and second wall sections (28 and 33) are parallel to the rear wall (12) of the first and second hollow portions (24, 25).

5. A package according to claim 1, in which a third opening (36) is arranged in the tab (34) and in a part of the rear wall (12) connected thereto, and the third opening (36) is circular in cross-section.

6. A package according to claim 1, in which a third opening (36) is arranged in the tab (34) and in a part of the rear wall (12) connected thereto, and the third opening (36) is formed as a longitudinal slot.

7. A package according to claim 1, in which a third opening (36) is arranged in the tab (34) and in a part of the rear wall (12) connected thereto, and the third opening (36) is formed as a longitudinal slot with circular cutouts adjoining a central region of said longitudinal slot.

8. A package according to claim 1, in which said side tabs (14) are arranged integrally on the rear wall (12) and are bent onto end walls (47) of the first and second hollow portions (24, 25).

9. A package according to claim 2, in which said side tabs (14) are arranged integrally on the rear wall (12) and are bent onto end walls (47) of the first and second hollow portions (24, 25) .

10. A package according to claim 1, in which the cover (46) has a viewing window (50) whose height (H) extends over a third wall (33) which is parallel to the rear wall (12), as far as a junction with said first side (27) which protrudes at right angles from the intermediate section (30) with a third wall section (28) which is parallel to the rear wall (12).

11. A package according to claim 10, in which at least one tear tab (52) which is bounded by perforations (51) is arranged in a section of the cover (46) which bounds the viewing window (50) at a level of the seat (41) of the at least one spark plug (40).

12. A package according to claim 11, in which a window (55) which exposes an electrode (54) of the spark plug (40) is arranged in the tear tab (52).

13. A package according to claim 1, in which the packaging material blank (10) is painted and printed on at least one side.

14. A package for at least one spark plug (40) formed from a packaging material blank (10) which is formed of cardboard and comprises a planar rear wall (12), a front wall (13), and has first and second spaced hollow portions (24 and 25) which are formed by the rear wall (12) and the front wall (13), said first hollow portion having a first side (27), said second hollow portion having a second side (31), said first and second sides lying opposite one another along a length of said package, said first side (27) having a first opening (37) for receiving a first end portion (63) of said at least one spark plug (40), said second side (31) having a second opening (38) for receiving a second end portion (62) of said at least one spark plug (40), the first and second sides (27, 31) of the first and second hollow portions (24, 25) lying opposite one another are connected to one another by means of an intermediate section (30) of said front wall which is connected integrally to said first and second hollow portions (24, 25), said front wall (13) has a tab (34) which projects from one end of said second hollow portion (25) and is permanently connected to a protruding part of the rear wall (12), and a sleeve (56) encloses part of the rear wall (12), the first and second hollow portions (24, 25) and end sides (47) of said first and second hollow portions while not enclosing the front wall tab and the protruding part of the rear wall.

15. A package according to claim 14, in which the sleeve (56) has a viewing window (57) whose height (h) extends over a third wall (33) which is parallel to the rear wall (12), as far as a junction with said first side (27) which protrudes at right angles from the intermediate section (30) with a third wall section (28) which is parallel to the rear wall (12).

16. A package according to claim 15, in which at least one tear tab (59) which is bounded by perforations (58) is arranged in a section of the sleeve (56) which bounds the viewing window (57) at a level of the seat (41) of the spark plug (40).

17. A package according to claim 16, in which a window (60) which exposes an electrode (54) of the spark plug (40) is arranged in the tear tab (59).

* * * * *